US005589656A

United States Patent [19]

Tortorici, Jr.

[11] Patent Number: 5,589,656

[45] Date of Patent: Dec. 31, 1996

[54] SPLIT WEDGE/BREECHBLOCK AND SEALING MEANS FOR GUN

[75] Inventor: Richard W. Tortorici, Jr., Schenectady, N.Y.

[73] Assignee: The United States of America as represented by the Secretary of the Army, Washington, D.C.

[21] Appl. No.: 613,736

[22] Filed: Feb. 12, 1996

[51] Int. Cl.[6] ..... F41A 3/74

[52] U.S. Cl. ..... 89/24; 89/26

[58] Field of Search ..... 89/22, 24, 25, 89/26; 42/23

[56] References Cited

U.S. PATENT DOCUMENTS

| | | | |
|---|---|---|---|
| 203,797 | 5/1878 | Tufts | 89/24 |
| 1,576,962 | 3/1926 | Froelich | 89/26 |
| 4,548,121 | 10/1985 | Janssen et al. | 89/26 |
| 5,042,361 | 8/1991 | Janssen et al. | 89/24 |

FOREIGN PATENT DOCUMENTS

| | | | |
|---|---|---|---|
| 3520418 | 12/1986 | Germany | 89/24 |
| 15309 | of 1911 | United Kingdom | 89/26 |
| 885361 | 12/1961 | United Kingdom | 89/26 |

*Primary Examiner*—Stephen M. Johnson

*Attorney, Agent, or Firm*—Saul Elbaum; Edward Goldberg; Michael C. Sachs

[57] ABSTRACT

A split wedge/breechblock for inserting and extracting the bridge seal from the powder chamber of a gun tube. The device includes a sealing mechanism for the sliding surfaces between the wedge and the breechblock, a bridge seal for use in the XM 297 gun system, and an improved stepped wedge and breechblock design which eliminates adverse downward forces during gun firing.

8 Claims, 4 Drawing Sheets

SPLIT WEDGE/BREECHBLOCK AND SEALING MEANS FOR GUN

GOVERNMENTAL INTEREST

The invention described herein may be manufactured, used and licensed by or for the Government for Governmental purposes without the payment to us of any royalties thereon.

BACKGROUND OF THE INVENTION

1. Field of the Invention

The present invention relates to a split wedge/breech block design for use in guns that develop high pressures upon firing, as well as to a sealing means for such guns.

2. Description of the Prior Art

The development of the XM 297 cannon system created sealing problems between mating cylinders which previously were not employed in similar guns. The 155 mm XM 297 cannon system creates pressures that vary from 5,000–65,000 psi with a total operating pressure impulse of approximately 25 milliseconds. The propellant used in the XM 297 gun system produces a high temperature, high pressure, corrosive environment. In order to overcome these extreme environmental conditions, the XM 297 gun seal has to be capable of responding to quick pressurize times and must be environmentally inert. The seal also has to be capable of withstanding the vibratory action associated with the XM 297 system.

The problem of sealing the interface between two mating cylinders was observed in the early test firing of the XM 297 gun. After initial testing, it was found that the prior art seal was missing or damaged by approximately 60 firings of the gun at low pressures. Such prior art seals were designed for a limited number of low pressure firings where the seal was readily accessible for replacement. A novel bridge seal was developed for this purpose and is disclosed in copending application Ser. No. 08/019,494, filed Feb. 16, 1993; Ser. No. 08/371,638 filed Jan. 12, 1995, and Ser. No. 08/540,111 filed Oct. 6, 1995.

Once the concept of a bridge sealing means was developed, it became necessary to develop a breechblock design for the purpose of inserting and extracting the new bridge seal from the powder chamber of the gun tube. Again, due to the novel type of sealing means employed in the XM 297 gun, this problem was not faced in prior art gun systems.

The split wedge/breech block design was developed with the knowledge that very little linear motion would be required to extract the bridge seal from the powder chamber of the gun tube. The split wedge/breechblock divided the breechblock into two parts slidably movable relative to one another. However, the development of the split wedge/breechblock design posed an additional problem, namely that a high pressure face seal was required to seal the two sliding flat surfaces of the wedge and breech block. A seal was needed which would accommodate two sliding surfaces and at the same time not be destroyed due to the reciprocating motion of the surfaces and the harsh conditions encountered in the gun.

Finally, it was discovered that under high pressure operation, the split wedge/breech block design could lead to an adverse downward force upon firing of the gun, which force was created by the wedge angle. This is because the force transmitted through the system (wedge, block and breechring) was not normal to the surfaces thereby creating a downward force when firing. As a result of this discovery, a more preferred version of the split wedge/breechblock design was developed to insert and extract the bridge seal. In the more preferred design, the motion of the split wedge/breechblock design is duplicated but stepped faces are employed in place of angular surfaces in order to ensure that the forces exerted by firing the gun are normal to the surfaces of the wedge and breechblock thereby eliminating the downward force which was generated during firing.

SUMMARY OF THE INVENTION

The present invention relates to a split wedge/breech block and the associated seals for use in the XM 297 gun system to insert and extract the bridge seal from the gun tube, wherein the gun tube and the wedge/breech block are subjected to both high and low pressures as well as corrosive gases and high temperatures.

More specifically, the present invention relates to a split wedge/breech block for inserting and extracting the bridge seal from the powder chamber of the gun tube, a sealing mechanism for the sliding surfaces between the wedge and the breechblock, a bridge seal for use in the XM 297 gun system, and an improved stepped wedge and breechblock design.

An object of the present invention is to provide a bridge seal which remains with the wedge as the wedge extracts or inserts the seal into the powder chamber and wherein the axis of the seal remains close to the axis of the seal seat within the powder chamber of the gun tube during extraction and insertion.

It is a further object of the present invention to provide a bridge seal which can freely move during preloading of the seal in order to ensure full preloading and thereby achieve complete sealing.

It is a further object of the present invention to provide a bridge seal which is freely movable when the system is under extreme pressure from to the firing of the gun.

It is a still further object of the present invention to provide a bridge seal which prevents leakage at pressures between 5,000 and 65,000 psi.

It is a still further object of the present invention to provide a means for inserting and extracting the bridge seal from the powder chamber of the gun tube in one continuous motion without complicated linkages or drives.

Yet another object of the present invention is to solve the problem of maintaining a high pressure face seal between the two sliding surfaces of the wedge and breechblock, which seal is also ported through a hole perpendicular to the surfaces.

A still further object of the present invention is to provide a split wedge/breechblock design which does not create an adverse downward force when the gun is fired.

These and other objects of the present invention will be apparent from the detailed description which follows.

DETAILED DESCRIPTION OF SPLIT-WEDGE-BREECHBLOCK EMBODIMENTS

Referring to the figures, like numerals represent like elements throughout the several views.

Figure 1:
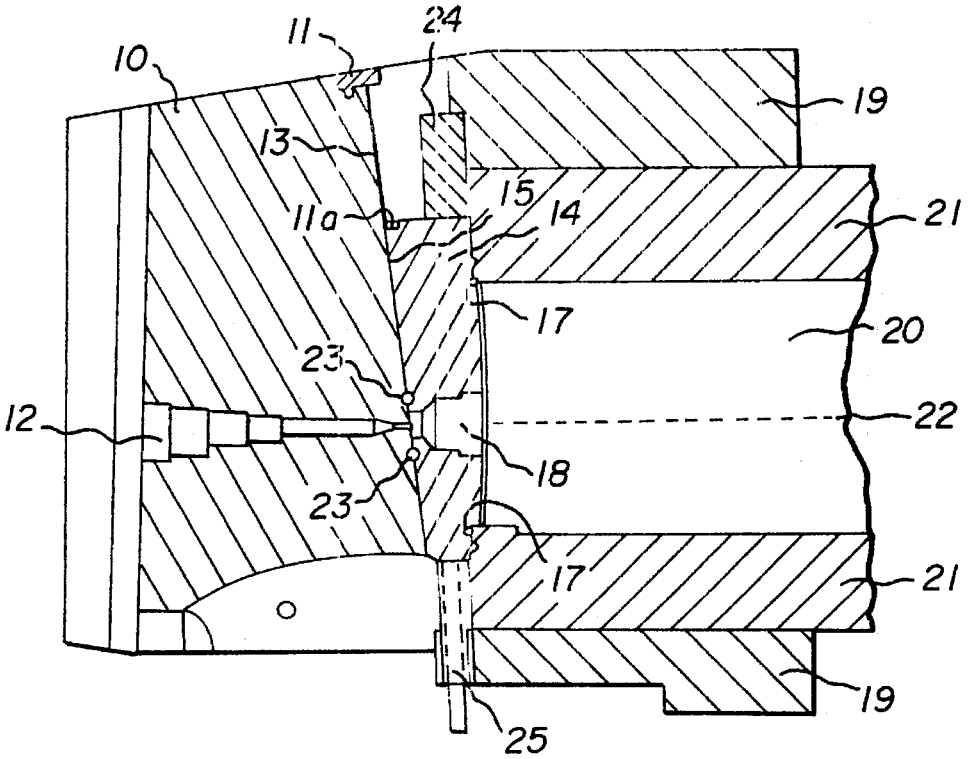
FIG. 1 is a longitudinal diametrical cross-sectional view of the split wedge/breechblock and gun tube cylinder of the present invention with the breechblock in the closed position.

In FIG. 1 is depicted the split wedge/breechblock and gun tube in longitudinal cross section. The embodiment of FIG. 1 is the split wedge/breechblock design which was developed to insert and extract the bridge seal from the powder chamber of a gun tube. The breechblock is shown in the closed position in FIG. 1.

Figure 2:
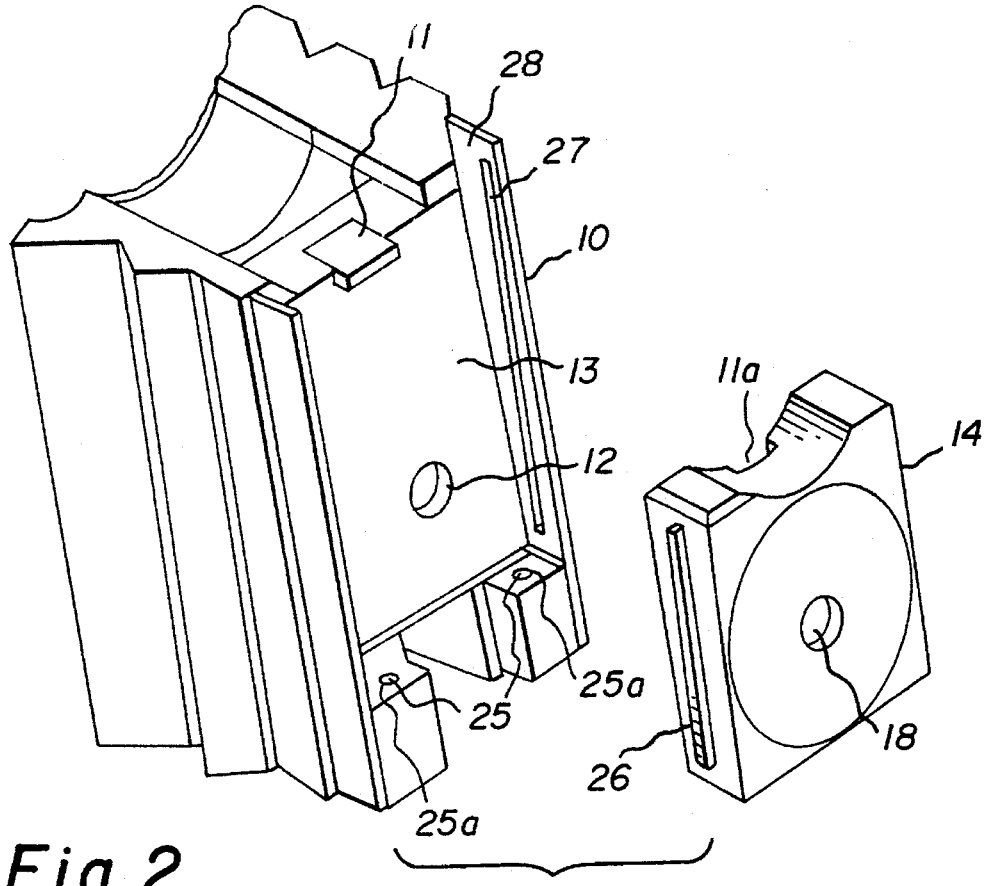
FIG. 2 is a perspective exploded view of the split wedge and breechblock of the present invention.

The apparatus of FIG. 1 includes a breechblock 10 having a retainer 11 at the top thereof and a port 12 which passes centrally through breechblock 10 in the longitudinal direction as can best be seen in FIG. 2. Port 12 is used for ignition of the propellant located in powder chamber 20. Breechblock 10 has an inclined face 13 which fits closely against an inclined wedge face 15 of wedge 14. Inclined face 13 of breechblock 10 is freely moveable along inclined wedge face 15 of wedge 14. Retainer 11 of breechblock 10 is positioned such that when breechblock 10 moves downwardly relative to wedge 14 from the closed position to the drawback position, retainer 11 engages with slot **11*a* in wedge 14 at drawback. Retainer 11 thereby prevents further downward movement of breechblock 10 relative to wedge 14 thereby facilitating the opening of powder chamber 20 by further downward movement of breechblock 10 and wedge 14** in unison.

Wedge 14 closes off powder chamber 20 of gun tube 21 when the breechblock 10 is in the closed position as in FIG. 1, except for wedge port 18 which is aligned with port 12 and bore centerline 22 in the closed position. Wedge 14 is sealed against the edges of gun tube 21 in the closed position by a bridge seal 17 which is shown in more detail in FIG. 9. Wedge port 18 is aligned with the bore center line 22 when breechblock 10 is in the closed position and serves as a channel through which ignition of the propellant in powder chamber 20 can be effectuated. Also, a breechring 19 surrounds gun tube 21 as shown.

In the closed position, Wedge 14 is held in position against gun tube 21 by pressure exerted on it in the longitudinal direction by breechblock 10. In the vertical direction, wedge 14 rests against stop 24 located above wedge 14. Stop 24 functions to position wedge 14 in vertical alignment with gun tube 21 prior to insertion of bridge seal 17. Wedge 14 is biased against stop 24 by a biasing means 25 which may be, for example, a spring and plunger as shown in the Figures. Other suitable biasing means may be employed for this purpose. Biasing means 25 should exert sufficient force to maintain wedge 14 against stop 24 during extraction or insertion. Once drawback is completed however, further vertical downward movement of breechblock 10 from the drawback position to the open position will cause wedge 14 to move along with breechblock 10 to thereby provide access to powder chamber 20.

The closed position of breechblock 10 and wedge 14 shown in FIG. 1 is the position employed during firing of the gun. Ignition of powder in the powder chamber is accomplished via port 12 and wedge port 18 using either laser ignition or primer ignition. In order to ensure sealing between inclined face 13 of breechblock 10 and inclined wedge face 15 of wedge 14 on either side of breechblock port 12 and wedge port 18, a sliding O-ring face seal 23 is located around breechblock port 12 and wedge port 18. Face seal 23 is shown in more detail in FIGS. 7–8.

Referring now to FIG. 2 there is shown a perspective exploded view of the first embodiment split wedge/breechblock of the present invention. As can be seen in FIG. 2, wedge 14 includes wedge port 18 located centrally therethrough. Wedge 14 also includes a guide rail 26 on each side of wedge 14 (only one can be seen in FIG. 2). Guide rails 26 are adapted to fit into two grooves 27 located on the inner surface of extending arms 28 of breechblock 10 such that during vertical movement of the breechblock 10 relative to wedge 14 from the closed position to the drawback position, breechblock 10 remains in engagement with wedge 14.

Guide rails 26 are inclined so as to be parallel to inclined face 13 and inclined wedge face 15. The inclination of rails 26 causes inclined wedge face 15 of wedge 14 to remain in close contact with inclined face 13 of breechblock 10 during downward movement of breechblock 10 from the closed position to the drawback position. In this manner, wedge 14 is caused to move slightly in the lateral direction away from gun tube 21 whereby bridge seals 17 are extracted from gun tube 21. In the drawback position, bridge seals 17 are clear of gun tube 21 so that wedge 14 can be moved downwardly out of alignment with powder chamber 20 and bore centerline 22 for reloading. The retainer 11 will engage with slot **11*a* in wedge 14 at drawback position thereby preventing any further relative downward sliding movement between breechblock 10 and wedge 14 and causing wedge 14 to be moved vertically downward along with breechblock 10** through further downward movement from the drawback position to the open position for reloading the gun.

Also shown in FIG. 2 are the tops of biasing means 25 which are located in cylindrical holes **25*a* of breechblock 10 such that biasing means 25 can move upwardly and downwardly within cylindrical holes 25*a*** during movement from the closed position to the drawback position and vice versa.

DETAILED DESCRIPTION OF THE PREFERRED SPLIT-STEPWEDGE-STEPBREECH BLOCK EMBODIMENTS

Figure 3:
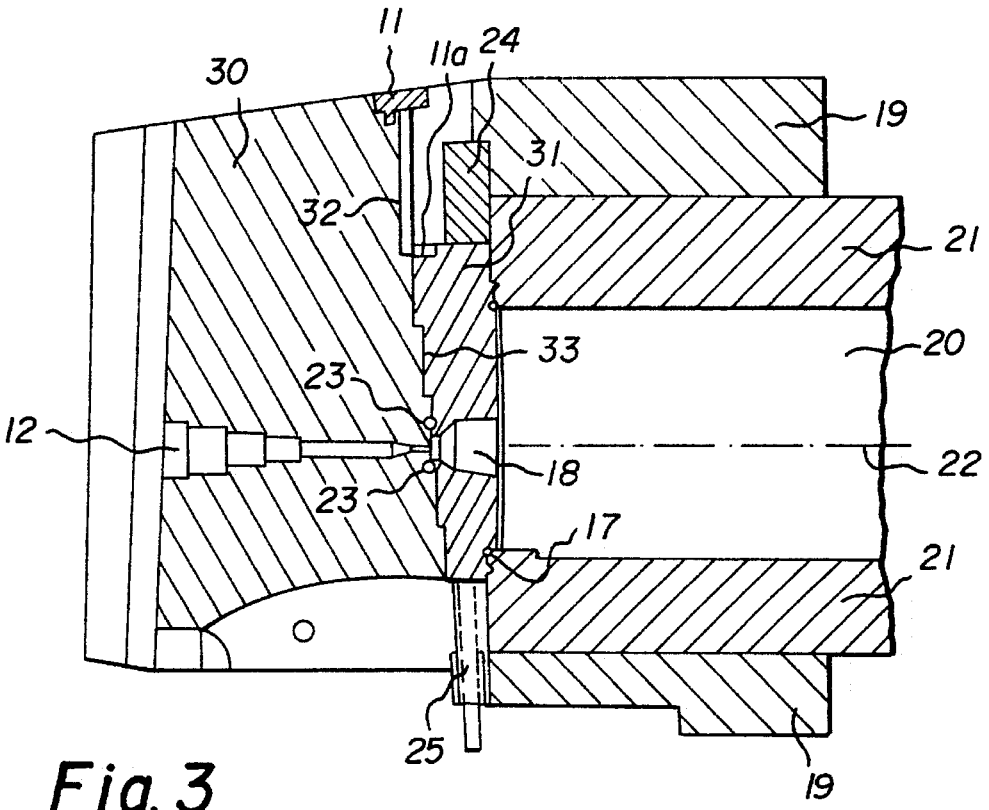
FIG. 3 is a longitudinal diametrical cross-sectional view of the split stepped wedge/breechblock and gun tube cylinder of the present invention with the breechblock in the closed position.
Figure 4:
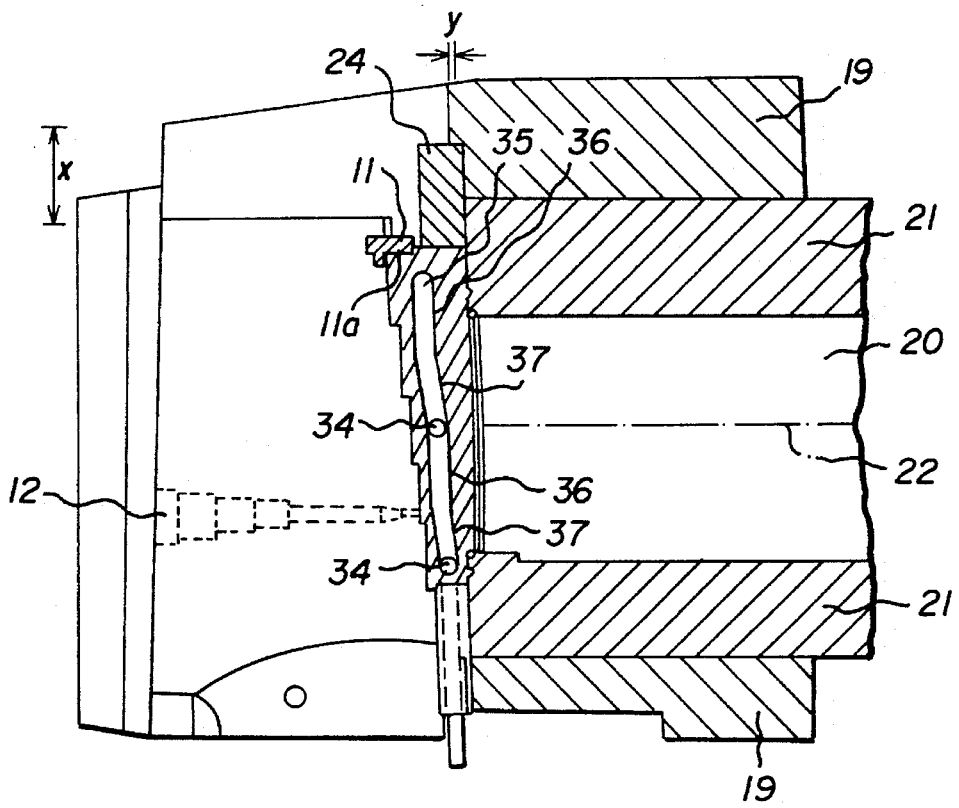
FIG. 4 is a longitudinal side view of the split stepped wedge/breechblock and gun tube cylinder of the present invention in partial cross-section with the breechblock in the drawback position.
Figure 5:
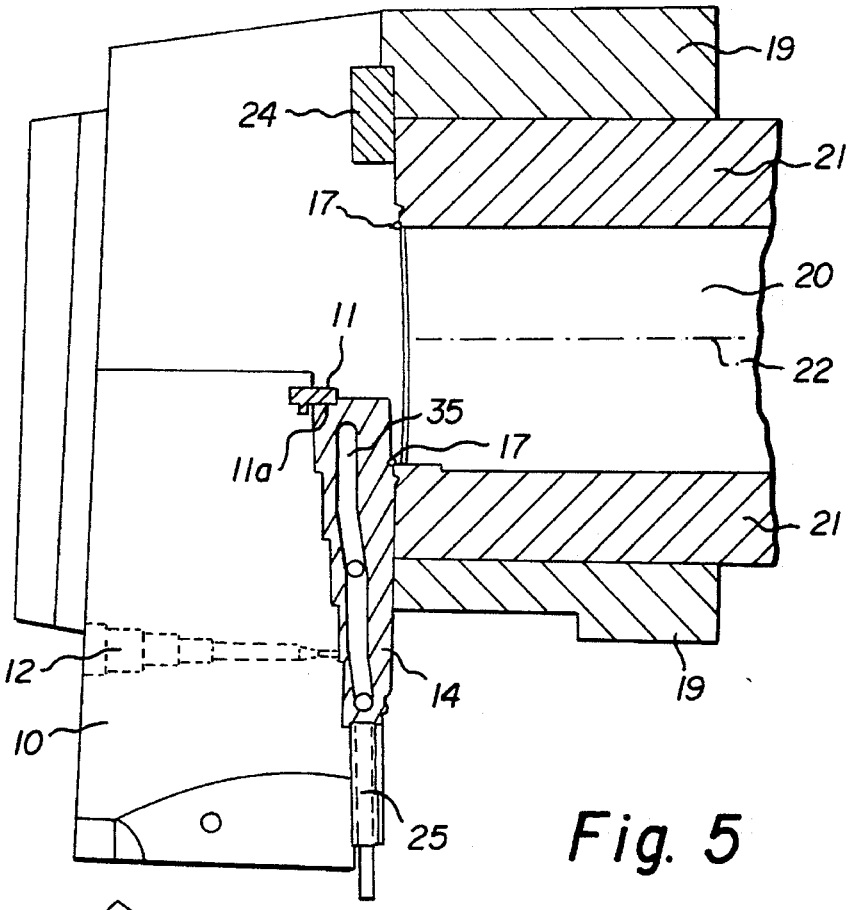
FIG. 5 is a longitudinal side view of the split stepped wedge/breechblock and gun tube cylinder of the present invention in partial cross-section with the wedge and breechblock in the open position.

Referring now to FIG. 3, there is shown a more preferred embodiment of the present invention. In this embodiment a stepped breechblock 30 and a stepped wedge 31 are employed. Stepped breechblock 30 and stepped wedge 31 each include several steps on the mating surfaces such that they mate together when the stepped breached block 30 and stepped wedge 31 are in the closed position as shown in FIG. 3 and when the stepped breechblock 30 is in the drawback position as shown in FIG. 4 and when the stepped breechblock 30 and stepped wedge 31 are in the open position as shown in FIG. 5. Stepped breechblock 30 includes a stepped face 32 which mates with the stepped wedge face 33 of stepped wedge 31.

Referring now to FIG. 4 there is shown a longitudinal side view in partial cross-section of the stepped breechblock 30 and stepped wedge 31 design as shown in FIG. 3 with the stepped breechblock 30 in the drawback position and the location of port 12 indicated by the dotted line in the figure. To reach the drawback position, stepped breechblock 30 is moved downwardly relative to stepped wedge 32 by a distance "x" as shown in FIG. 4. As a result of the inclination of the lug bearing face 40 of stepped breechblock 30, stepped wedge 31 is caused to partially draw back out of engagement with the edges of gun tube 21 by a small distance "y" as shown in the figure. This occurs within the dwell section 36 of cam path 35 of stepped wedge 31 shown in FIGS. 3–4.

Stepped breechblock 30 continues to move downward by any suitable means (not shown). During drawback, stepped wedge 31 is maintained in its vertical position against stop 24 by biasing means 25. Again, biasing means 25 should exert sufficient force to maintain stepped wedge 31 against stop 24 during drawback.

In order to facilitate complete drawback, stepped breechblock 30 includes rollers 34 which ride in cam path 35 of stepped wedge 31 as shown in FIGS. 4–5. The cam path 35 consists of 2 phases, "the dwell section" and "the inclined drawback section." The dwell section 36 of cam path 35 is perpendicular to gun tube 21 and parallel to the vertical axis of stepped wedge 31 whereby stepped breechblock 30 is guided downwardly perpendicular to gun tube 21 during the first phase of its movement. After moving downward a sufficient distance to disengage the steps of the stepped face 32 of stepped breechblock 30 from the steps of the stepped wedge face 33, the rollers 34 of stepped breechblock 30 reach the inclined drawback section 37 of cam path 35. Drawback section 37 is inclined relative to the vertical axis of stepped wedge 31 in order to cause stepped wedge 31 to move laterally towards stepped breechblock 30 during further downward movement of stepped breechblock 30 relative to stepped wedge 31 until the retainer 11 engages with slot **11*a* in wedge 31 in the drawback position as shown in FIG. 4 when rollers 34 reach the lower end of cam path 35. This causes complete lateral movement of stepped wedge 31 away from gun tube 21 to disengage bridge seals 17 from gun tube 21 as shown in FIG. 3. As can also be seen in FIG. 4, during drawback stepped wedge 31 does not move downwardly and thus wedge port 18 remains aligned with bore centerline 22** in the drawback position.

Referring now to FIG. 5 there is shown the stepped breechblock 30 and stepped wedge 31 in the open position. In order to reach the open position from the drawback position of FIG. 4, stepped breechblock 30 moves further downwardly in a direction substantially perpendicular to gun tube 21. Since retainer 11 is engaged with slot **11*a* of stepped wedge 31 at complete drawback further downward movement of breechblock 30 relative to wedge 31 is prevented thus facilitating the opening of the powder chamber 20 by further downward movement of breechblock 30 and wedge 31** in unison.

Figure 6:
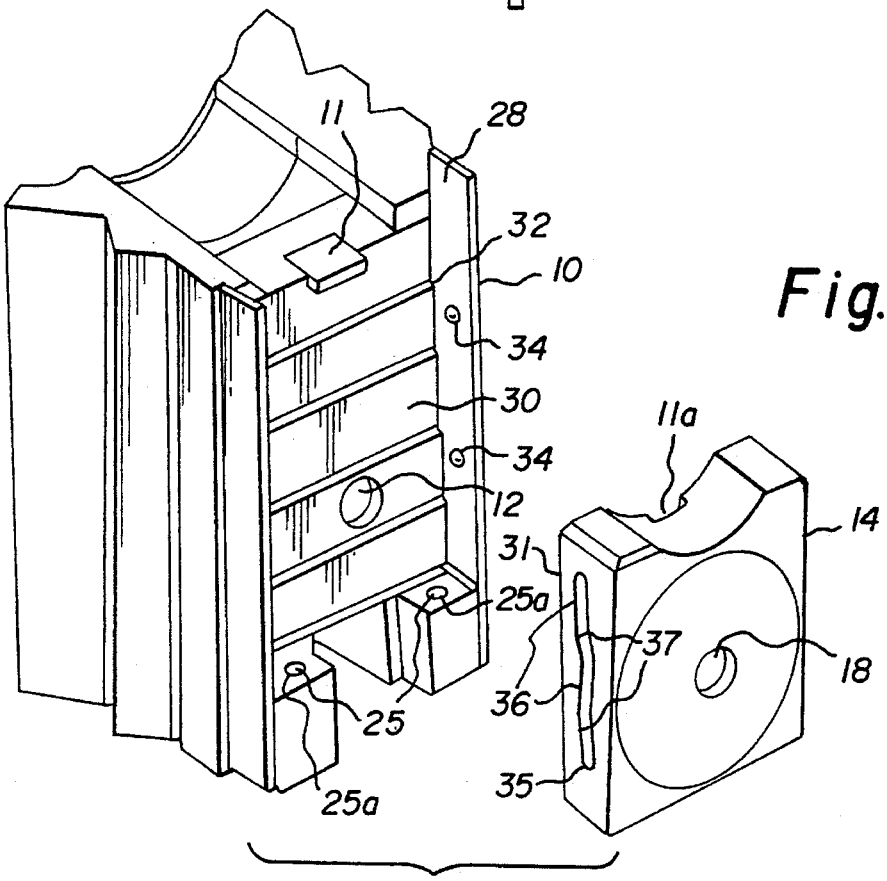
FIG. 6 is a perspective exploded view of the stepped breechblock and stepped wedge of the present invention.

Referring now to FIG. 6 there is shown a perspective exploded view of stepped breechblock 30 and stepped wedge 31. Several of the elements described above with respect to FIGS. 3–5 can be seen more clearly in this figure. In particular, this figure shows that the cam path 35 is located on the side edge of stepped wedge 31 and the rollers 34 are positioned on the inner surfaces of extending arms 28 of stepped breechblock 30.

Figure 7:
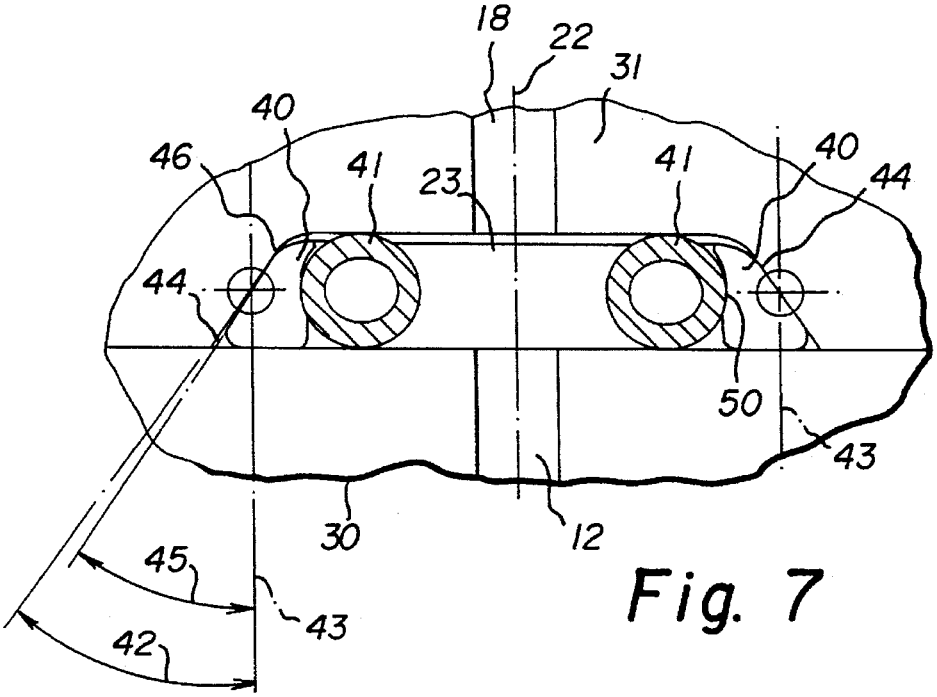
FIG. 7 is a partial cross-sectional view of the breechblock and wedge showing the face seal therebetween in the preloaded state.
Figure 8:
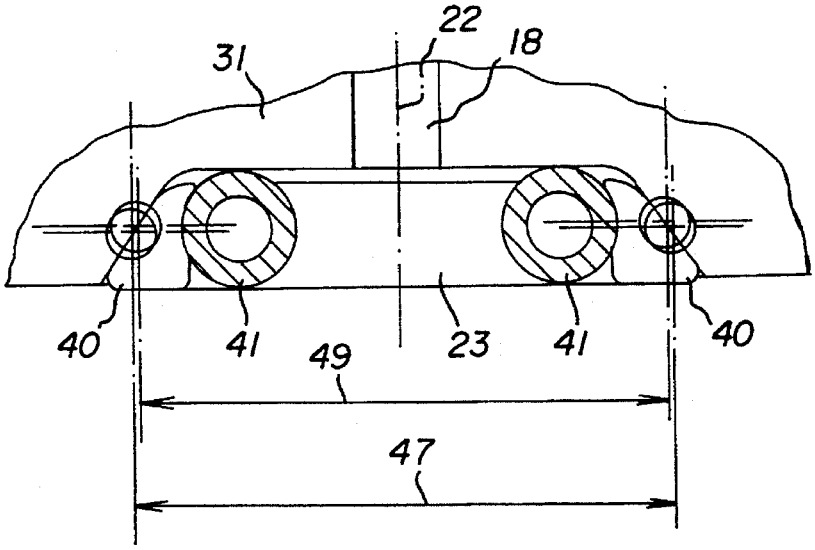
FIG. 8 is a partial cross-sectional view of the breechblock and wedge showing the face seal for sealing the space between the sliding surfaces thereof.

Referring now to FIG. 7 there is shown a detailed view of the face seal 23. Face seal 23 includes wedge seal 40 and vented metal O-rings 41. Wedge seal 40 sits on seal seat 44. Seat angle 42, which is the angle between a line parallel to the gun tube 21 shown as 43 and seal seat 44 must be slightly larger than seal angle 45 as shown in FIG. 7 which is the angle between a line parallel to gun tube 21 as depicted by 43 and the sealing surface 46 of wedge seal 40, in order to provide a mismatch between the seal angle 45 and the seal seat angle 42 which creates high contact stresses at the mating vertex of the mismatched angles 42, 45 during preloading of face seal 23. In this manner an initial seal is created at assembly. It is important to keep seal seat 44 highly polished in order prevent damage to wedge seal 40 which could be caused by the high contact stresses at the mating vertex of the mismatched angles 42, 45.

The datum diameter 47 of wedge seal 40 is dimensionally larger than the datum diameter 49 of seal seat 44 also for the purpose of creating a mismatch between wedge seal 40 and seal seat 44. This also helps to create the preload condition on face seal 23 mentioned above which is depicted in FIG. 7 and which occurs when the sliding surfaces of breechblock 30 and wedge 31 are mated. Again, this mismatch creates high contact stresses at the mating vertex of the mismatched angles in order to provide a good seal.

Seal inside diameter 49 is dimensionally smaller than the vented metal O-ring 41 in order to facilitate a slight press assembly. O-ring seat 50 of wedge seal 40 is needed to provide vented metal O-ring 41 with a seat that supports vented metal O-ring 41 in full contact so that under the full gun pressure of approximately 65,000 psi, the contact stresses will not exceed the yield stress of the vented metal O-ring 41 and destroy the vented metal O-ring 41. The location of the radius of the O-ring seat 50 on the wedge seal 40 must be such that the outside diameter of the vented metal O-ring is tangential to the sliding face 44 of the wedge seal 40 as shown in FIG. 7.

Wedge seal 40 must be of a material which provides a sufficient wear surface, both to withstand repeated cycling and also to protect the vented metal O-ring 41 from excessive wear. Sliding face 44 of wedge seal 40 must be highly polished to facilitate sealing between the two sliding surfaces. The function of vented metal O-ring 41 is to exert force on wedge seal 40 as pressure is applied. It also provides sealing at contacting surfaces. The function of wedge seal 40 is to seal on the face of sliding components within the angled mating surfaces while also providing a protective wear envelope for vented metal O-ring 41.

Figure 9:
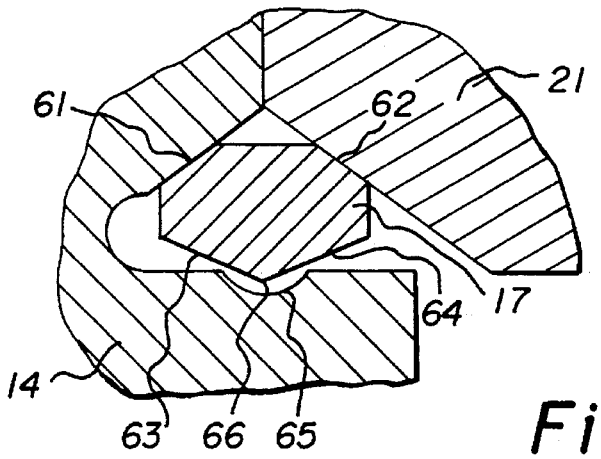
FIG. 9 is a longitudinal diametrical cross-sectional view of the gun tube cylinder and the wedge areas showing the bridge seal in the pre-loaded state.

Referring now to FIG. 9 there is shown bridge seal 17 in greater detail. The shape of bridge seal 17 is important and in this respect, bridge seal 17 includes surfaces 61–64 which function in providing a good seal. Surface 61 is adapted to engage with wedge 17 and surface 62 is adapted to engage with gun tube 21. As shown in FIG. 9, wedge 14 includes an indentation 65 which accommodates a point 66 of bridge seal 17. Bridge seal 17 is just large enough so that it cannot escape from wedge 14. However, indentation 65 provides some freedom of movement for bridge seal 17 when wedge 14 is in the drawback position. As wedge 14 is moved into the closed position as shown in FIG. 9, surfaces 61 and 62 of bridge seal 17 are squeezed between wedge 14 and gun tube 21 in order to provide a seal at the interface of wedge 14 and gun tube 21 to prevent leakage of combustion gases through gap 67.

Bridge seal 17 of the present invention provides a means whereby bridge seal 17 remains interlocked with wedge 14 during extraction and insertion from gun tube 21 and bridge seal 17 remains close to the axis of the seal seat 22 of FIG. 3 within gun tube 21 during extraction and insertion. Further, bridge seal 17 is a freely moveable within wedge 14 in order to prevent interference with bridge seal 17 by wedge 14 during preloading. In this manner a full preload can be obtained and bridge seal 17 is consistently trapped between wedge 14 and gun tube 21 in the sealing position. Bridge seal 17 is capable of preventing leakage under the full pressure range of the system of 5,000–65,000 psi because the seal is not attached to anything and thus it is free to expand away from the wedge 14 as pressure is applied to thereby accommodate setback of breechblock 30 of FIG. 3 during firing of the gun.

The foregoing description has been presented for the purposes of illustration and description only and is not to be construed as limiting the invention in any way. The scope of the invention is to be determined from the claimed appended hereto.

What is claimed is:

1. A split stepped wedge/breechblock apparatus for opening and closing a powder chamber of a gun tube of a high pressure gun, said apparatus comprises:

a wedge member having a first side adapted to fit against the one end of the gun tube to thereby close the powder chamber of the gun tube, said wedge member including a central longitudinal port which passes from the first side of the wedge member through to a second side of the wedge member and is aligned with the bore centerline of the gun tube when the first side of the wedge member is fitted against the gun tube, said wedge member further including a sealing means associated with the first side of the wedge member for sealing the wedge member against the gun tube and the second side of the wedge member forming a stepped face, a breechblock having a first side which includes a stepped face adapted to closely fit with the stepped face of said wedge member, said breechblock including a central longitudinal port which passes from said first side through to a second side and which is aligned with the central port of said wedge member when said breechblock is in a first, closed position, said breechblock being capable of a movement along a path substantially perpendicular to the bore centerline of the gun tube from said first, closed position to a second, open position, and means for coupling said breechblock and said wedge member together so as to cause the sealing means of said wedge member to be drawn out of engagement with the gun tube to a drawback position during a first phase of said movement of said breechblock and causes said wedge member to move out of alignment with said gun tube to thereby open the powder chamber during a second portion of said movement of said breechblock.

2. A breechblock apparatus as claimed in claim 1 wherein said breechblock comprises two extending arms each of which extends around at least a portion of said wedge member.

3. A breechblock apparatus as claimed in claim 2 wherein said sealing means comprises a bridge seal.

4. A breechblock apparatus as claimed in claim 3 further comprising a face sealing means located between the stepped face of said breechblock and the stepped face of said wedge member for sealing the space between said breechblock and said wedge member to prevent escape of gases from said longitudinal ports when said breechblock apparatus is in the closed position.

5. A breechblock apparatus as claimed in claim 4 wherein said face sealing means comprises an annular wedge sealing member having a wedge seal angle which is mismatched with a seal seat angle between a line parallel to the bore centerline and a seal seat to thereby create an interference fit between said wedge sealing member and the seal seat.

6. A breechblock apparatus as claimed in claim 5 wherein said wedge sealing member includes an O-ring seat formed therein and said face sealing means further comprises a vented O-ring adapted to fit into said O-ring seat in said wedge sealing member.

7. A breechblock apparatus as claimed in claim 2 wherein said coupling means comprises at least one pair of rollers located on a surface of each extending arm which is closely associated with said wedge member, said at least one pair of rollers being aligned with each other substantially perpendicular to the bore centerline of the gun tube, and at least one cam path located on respective edges of said wedge member such that said rollers ride in said cam paths during movement of said breechblock relative to said wedge member.

8. A breechblock apparatus as claimed in claim 7 wherein said cam path includes a first section aligned substantially perpendicular to the bore centerline of the gun tube and a second section aligned with said stepped faces of said wedge member and said breechblock.

* * * * *